US007579310B2

(12) United States Patent
Kasturi et al.

(10) Patent No.: US 7,579,310 B2
(45) Date of Patent: Aug. 25, 2009

(54) LIQUID DETERGENT COMPOSITION EXHIBITING ENHANCED α-AMYLASE ENZYME STABILITY

(75) Inventors: Chandrika Kasturi, Cincinnati, OH (US); Mark Edward Wandstrat, Cincinnati, OH (US); Brian Xiaoqing Song, West Chester, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 144 days.

(21) Appl. No.: 11/195,538

(22) Filed: Aug. 2, 2005

(65) Prior Publication Data

US 2006/0019856 A1 Jan. 26, 2006

Related U.S. Application Data

(63) Continuation of application No. 09/795,211, filed on Feb. 28, 2001, now abandoned.

(51) Int. Cl.
*C11D 3/386* (2006.01)

(52) U.S. Cl. ..... 510/393; 510/221; 510/226; 510/235; 510/238; 510/276; 510/280; 510/336; 510/337; 510/339; 510/348; 510/392; 510/403; 510/405; 510/530

(58) Field of Classification Search ..... 510/393, 510/320, 321, 441–445, 392, 221, 226, 235, 510/238, 276, 280, 336, 337, 339, 348, 403, 510/405, 530; 435/202
See application file for complete search history.

(56) References Cited

U.S. PATENT DOCUMENTS 5,955,415 A * 9/1999 Gutierrez et al. ..... 510/312
6,093,562 A * 7/2000 Bisg.ang.rd-Frantzen et al. 435/202
6,268,329 B1 * 7/2001 Markussen ..... 510/392

* cited by examiner

*Primary Examiner*—Lorna M Douyon
*Assistant Examiner*—Amina Khan
(74) *Attorney, Agent, or Firm*—Armina E. Matthews; Kim William Zerby

(57) ABSTRACT

An aqueous liquid or gel type detergent composition comprising boric acid or a boron compound, a polyhydroxy compound, and a relatively high level of calcium ion to stabilize a selected α-amylase enzyme is described.

16 Claims, No Drawings

LIQUID DETERGENT COMPOSITION EXHIBITING ENHANCED α-AMYLASE ENZYME STABILITY

RELATED APPLICATION

The present application is a continuation of application Ser. No. 09/795,211 filed Feb. 28, 2001, now abandoned.

TECHNICAL FIELD

The present invention relates to aqueous liquid or gel type detergent compositions comprising a combination of boric acid or a boron compound capable of forming boric acid in the composition, a polyhydroxy compound, preferably propanediol, and a relatively high level of calcium ion to stabilize a selected α-amylase enzyme. The invention also relates to a process for enhancing stability of the α-amylase enzyme in a liquid or gel detergent composition.

BACKGROUND OF THE INVENTION

Aqueous liquid and gel detergent compositions containing enzymes, including amylases, are well known in the art. The major problem encountered with such compositions is that of ensuring a sufficient storage stability of the enzymes in the compositions. It is particularly difficult to stabilize amylases in the presence of proteases, which can readily degrade amylases in aqueous liquid or gel detergent compositions.

High-alkaline amylases such as alpha amylases are described in British Specification No. 1,296,839. The use of an enzyme stabilizing system comprising a mixture of boric acid or an alkali metal borate with calcium ion, and preferably with a polyol, is disclosed in U.S. Pat. No. 4,537,706, Severson. Certain α-amylases that provide improved cleaning and stain removal are disclosed in WO97/32961, Baeck et al., and in WO96/23873 and U.S. Pat. No. 6,093,562.

The present invention utilizes low levels of boric acid and polyhydroxy compound in combination with a relatively high level of calcium ion to provide surprisingly good stability of selected α-amylase enzymes.

SUMMARY OF THE INVENTION

The invention relates to an aqueous liquid or gel type detergent composition containing a selected α-amylase enzyme having improved stability, and a process for stabilizing the amylase enzyme in such a composition. The detergent compositions herein are useful for cleaning tableware (e.g., glassware, china, silverware, plastic, etc.), kitchenware, household surfaces such as floors, bathroom fixtures and countertops, and fabrics. The compositions may be fully formulated cleaning products or they may be additive or specialty products that can be used alone or with other cleaning products. Particularly preferred compositions herein are for use in automatic dishwashing machines.

In one aspect of the present invention, an aqueous liquid or gel type detergent composition comprises, by weight (1) from about 0.1% to about 15% of boric acid or a boron compound capable of forming boric acid in the composition; (2) from about 0.1% to about 10% of a polyhydroxy compound selected from the group consisting of ethylene glycol, propylene glycol, 1,2-propanediol, butylene glycol, hexylene glycol, glycerol, mannitol, sorbitol, erythritol, glucose, fructose, lactose, erythritol-1,4-anhydride, and mixtures thereof; (3) from about 10 to about 100 millimoles of calcium ion per liter of composition; (4) from about 5% to about 90% water; and (5) an α-amylase enzyme, as defined hereinafter.

In another aspect of the present invention, a process for stabilizing an amylase enzyme in an aqueous liquid or gel type detergent composition comprises mixing, with detergent ingredients (1) from about 0.1% to about 15% by weight, of boric acid or a boron compound capable of forming boric acid in the composition; (2) from about 0.1% to about 10% by weight, a polyhydroxy compound selected from the group consisting of ethylene glycol, propylene glycol, 1,2-propanediol, butylene glycol, hexylene glycol, glycerol, mannitol, sorbitol, erythritol, glucose, fructose, lactose, erythritol-1,4-anhydride, and mixtures thereof; (3) from about 10 to about 100 millimoles of calcium ion per liter of composition; and (4) an α-amylase enzyme, as defined hereinafter.

DETAILED DESCRIPTION OF THE INVENTION

The present invention relates to an aqueous liquid or gel type detergent composition comprising boric acid or a boron compound capable of forming boric acid in the composition, a polyhydroxy compound, calcium ions, and selected α-amylase enzyme.

The boric acid or boron compound capable of forming boric acid in the composition, is desirably present in an amount from about 0.5% to about 10% by weight, and preferably from about 1% to about 5%, and more preferably from about 2% to about 4% by weight (calculated on the basis of boric acid present). Boric acid is particularly preferred herein, although other compounds such as boric oxide, borax and other alkali metal borates (e.g., sodium ortho-, meta-, and pyroborate, and sodium pentaborate) are suitable. Substituted boric acids (e.g., phenylboronic acid, butane boronic acid, and p-bromo phenylboronic acid) can also be used in place of boric acid.

The compositions of the present invention also contain a polyhydroxy compound as described above. The polyhydroxy compound preferably contains from 2 to 6 carbon atoms and from 2 to 6 hydroxy groups, and is preferably selected from propylene glycol, ethylene glycol, glycerol, sorbitol, and glucose, and mixtures thereof. The polyhydroxy compound is preferably 1,2-propanediol. In the preferred embodiment, the polyhydroxy compound is desirably present in an amount from about 0.1% to about 7% by weight, preferably from about 0.1% to about 5% by weight, and more preferably, from about 0.1% to about 3% by weight. Most preferably, the polyhydroxy compound is present at a level of from about 0.2% to about 1% by weight.

The compositions herein also contain from about 10 to about 100, preferably from about 13 to about 50, more preferably from about 15 to about 30, and most preferably from about 18 to about 25, millimoles of calcium ion per liter of composition. The level of calcium ion should be selected so that there is always some minimum level available for the enzyme, after allowing for complexation with components such as builders, fatty acid, etc., in the composition. Any water-soluble calcium salt can be used as the source of calcium ion, including calcium chloride, calcium formate, and calcium acetate. A small amount of calcium ion, generally from about 0.05 to about 0.4 millimoles per liter, is often also present in the composition due to calcium in the enzyme slurry and formula water.

The compositions herein contain from about 5% to about 90%, preferably from about 20% to about 80%, more preferably from about 40% to about 75% of water.

The compositions of the present invention also contain from about 0.01% to about 5%, preferably from about 0.1% to about 2%, by weight of the α-amylase enzyme herein, which is typically available as a dilute (e.g., 2-4% active) slurry in water. On a pure, active enzyme basis, the compositions of the invention can contain from about 0.0001% to about 0.1%, preferably from about 0.001% to about 0.05%, by weight of the α-amylase.

The α-amylases herein are described in WO97/32961, incorporated herein by reference, as "specific amylase enzymes". These amylases include:

(a) α-amylases characterised by having a specific activity at least 25% higher than the specific activity of Termamyl® at a temperature range of 25° C. to 55° C. and at a pH value in the range of 8 to 10, measured by the Phadebas® α-amylase activity assay. Such Phadebas® α-amylase activity assay is described at pages 9-10, WO95/26397.

(b) α-amylases according (a) comprising the amino sequence shown in SEQ ID No. 1 of WO97/32961 or an α-amylase being at least 80% homologous with the amino acid sequence shown in SEQ ID No.1.

(c) α-amylases according (a) comprising the amino sequence shown in SEQ ID No.2 of WO97/32961 or an α-amylase being at least 80% homologous with the amino acid sequence shown in SEQ ID No.2.

(d) α-amylases according (a) comprising the following amino sequence in the N-terminal: His-His-Asn-Gly-Thr-Asn-Gly-Thr-Met-Met-Gln-Tyr-Phe-Glu-Trp-Tyr-Leu-Pro-Asn-Asp (SEQ ID No.3) or an α-amylase being at least 80% homologous with the amino acid sequence shown (SEQ ID No.3) in the N-terminal.

A polypeptide is considered to be X% homologous to the parent amylase if a comparison of the respective amino acid sequences, performed via algorithms, such as the one described by Lipman and Pearson in Science 227, 1985, p. 1435, reveals an identity of X%.

(e) α-amylases according (a-d) wherein the α-amylase is obtainable from an alkalophilic *Bacillus* species; and in particular, from any of the strains NCIB 12289, NCIB 12512, NCIB 12513 and DSM 935. In the context of the present invention, the term "obtainable from" is intended not only to indicate an amylase produced by a *Bacillus* strain but also an amylase encoded by a DNA sequence isolated from such a *Bacillus* strain and produced in an host organism transformed with said DNA sequence.

(f) α-amylase showing positive immunological cross-reactivity with antibodies raised against an α-amylase having an amino acid sequence corresponding respectively to SEQ ID No.1, ID No.2 or ID No.3.

(g) Variants of the following parent α-amylases which (i) have one of the amino acid sequences shown in SEQ ID No.1, ID No.2 or ID No.4 respectively, or (ii) displays at least 80% homology with one or more of said amino acid sequences, and/or displays immunological cross-reactivity with an antibody raised against an α-amylase having one of said amino acid sequences, and/or is encoded by a DNA sequence wich hybridizes with the same probe as a DNA sequence encoding an α-amylase having one of said amino acid sequence; in which variants:

1. at least one amino acid residue of said parent α-amylase has been deleted; and/or
2. at least one amino acid residue of said parent α-amylase has been replaced by a different amino acid residue; and/or
3. at least one amino acid residue has been inserted relative to said parent α-amylase; said variant having an α-amylase activity and exhibiting at least one of the following properties relative to said parent α-amylase: increased thermostability, increased stability towards oxidation, reduced Ca ion dependency, increased stability and/or α-amylolytic activity at neutral to relatively high pH values, increased α-amylolytic activity at relatively high temperature and increase or decrease of the isoelectric point (pI) so as to better match the pI value for α-amylase variant to the pH of the medium.

Said variants are described in WO96/23873 and U.S. Pat. No. 6,093,562, issued Jul. 25, 2000, both incorporated herein by reference.

A particularly preferred α-amylase herein is Natalase®, available from Novo, which has amino acid sequence shown in Seq. ID No. 2 in WO 97/32961 with the Aspartic Acid (Asp or D) at position 183 and the Glycine (Gly or G) at position 184 deleted.

In the present invention, it has surprisingly been found that the combination of boric acid or boron compound, polyhydroxy compound, and calcium ion at the levels herein unexpectedly stabilizes the selected α-amylase enzyme compared to other α-amylase enzymes such as Termamyl®.

Other Detergent Ingredients

The compositions of the invention may also contain additional components generally found in detergent compositions. The compositions may contain surfactants, especially anionic and/or nonionic surfactants, solvents, clay, polycarboxylate thickeners, baking soda, brighteners, carbonates, phosphates, dicarboxylic acid, siloxanes, perfumes, bleach and bleach catalysts, and mixtures thereof. Preferred components are discussed in more detail hereafter.

(a) Thickeners

The physical stability of the liquid product may be improved and the thickness of the liquid product may be altered by the addition of a cross-linking polyacrylate thickener to the liquid detergent product as a thixotropic thickener.

Thickeners for use herein include those selected from clay, polycarboxylates, such as Polygel®, gums, carboxymethyl cellulose, polyacrylates, and mixtures thereof. Clay thickeners herein preferably have a double-layer structure. The clay may be naturally occurring, e.g., Bentonites, or artificially made, e.g., Laponite®. Laponite® is supplied by Southern Clay Products, Inc. See *The Chemistry and Physics of Clays*, Grimshaw, 4$^{th}$ ed., 1971, pages 138-155, Wiley-Interscience.

(b) pH Adjusting Components

The above liquid detergent product is preferably low foaming, readily soluble in the washing medium and most effective at pH values best conducive to improved cleaning performance, such as in a range of desirably from about pH 6.5 to about pH 12.5, and preferably from about pH 7.0 to about pH 12.0, more preferably from about pH 8.0 to about pH 11.0, when measured at a concentration of 1% by weight in water. Preferably the pH is from about 8.5 to about 10.5, most preferably from about 8.5 to about 10.0. The pH adjusting components are desirably selected from sodium or potassium hydroxide, sodium or potassium carbonate or sesquicarbonate, sodium or potassium silicate, boric acid, sodium or potassium bicarbonate, sodium or potassium borate, and mixtures thereof. NaOH or KOH are the preferred ingredients for increasing the pH to within the above ranges. Other preferred pH adjusting ingredients are sodium carbonate, potassium carbonate, and mixtures thereof.

(c) Surfactant

Compositions of the present invention preferably contain a low foaming nonionic surfactant, preferably an alkyl ethoxylate surfactant. A preferred surfactant is SLF18® manufactured by BASF Corporation. Surfactants herein are generally present in a range of from about 0.1% to about 10% by weight of the composition. Surfactants useful herein are described in more detail in WO 98/03622, published Jan. 29, 1998, and in U.S. Pat. No. 4,537,707, both incorporated herein by reference.

(d) Builder

The compositions of the present invention also preferably contain one or more detergent builders to assist in controlling mineral hardness and in the removal of particulate soils. Inorganic as well as organic builders can be used.

The level of builder can vary widely depending upon the end use of the composition and its desired physical form. When present, the compositions will typically comprise at least about 1% builder. Preferred compositions comprise from about 5% to about 50%, more preferably about 10% to about 30%, by weight, of detergent builder. Lower or higher levels of builder, however, are not meant to be excluded.

Inorganic or P-containing detergent builders include, but are not limited to, the alkali metal, ammonium and alkanolammonium salts of polyphosphates (exemplified by the tripolyphosphates, and glassy polymeric meta-phosphates), phosphonates, phytic acid, silicates, carbonates (including bicarbonates and sesquicarbonates), and aluminosilicates.

Examples of silicate builders are the alkali metal silicates, particularly those having a $SiO_2$:$Na_2O$ ratio in the range 1.6:1 to 3.2:1 and layered silicates, such as the layered sodium silicates described in U.S. Pat. No. 4,664,839, issued May 12, 1987 to H. P. Rieck. NaSKS-6 is the trademark for a crystalline layered silicate marketed by Hoechst (commonly abbreviated herein as "SKS-6"). NaSKS-6 can be prepared by methods such as those described in German DE-A-3,417,649 and DE-A-3,742,043. Other layered silicates, such as those having the general formula $NaMSi_xO_{2x+1}.yH_2O$ wherein M is sodium or hydrogen, x is a number from 1.9 to 4, preferably 2, and y is a number from 0 to 20 can be used herein. Various other layered silicates from Hoechst include NaSKS-5, NaSKS-7 and NaSKS-11, as the alpha, beta and gamma forms.

Examples of carbonate builders are the alkaline earth and alkali metal carbonates as disclosed in German Patent Application No. 2,321,001 published on Nov. 15, 1973.

Aluminosilicate builders may be useful in the present invention. Aluminosilicate builders include those having the empirical formula:

$$M_z(zAlO_2)y]xH_2O$$

wherein z and y are integers of at least 6, the molar ratio of z to y is in the range from 1.0 to about 0.5, and x is an integer from about 15 to about 264.

Useful aluminosilicate ion exchange materials are commercially available. A method for producting aluminosilicate ion exchange materials is disclosed in U.S. Pat. No. 3,985,669, Krummel, et al, issued Oct. 12, 1976. Preferred synthetic crystalline aluminosilicate ion exchange materials useful herein are available under the designations Zeolite A, Zeolite P (B), Zeolite MAP and Zeolite X. In an especially preferred embodiment, the crystalline aluminosilicate ion exchange material has the formula:

$$Na_{12}[AlO_2)_{12}(SiO_2)_{12}]xH_2O$$

wherein x is from about 20 to about 30, especially about 27. This material is know as Zeolite A. Dehydrated zeolites (x=0-10) may also be used herein. Preferably, the aluminosilicate has a particle size of about 0.1-10 microns in diameter.

Organic detergent builders suitable for the purposes of the present invention include, but are not restricted to, a wide variety of polycarboxylate compounds. As used herein, "polycarboxylate" refers to compounds having a plurality of carboxylate groups, preferably at least 3 carboxylates. Polycarboxylate builder can generally be added to the composition in acid form, but can also be added in the form of a neutralized salt. When utilized in salt form, alkali metals, such as sodium, potassium, and lithium, or alkanolammonium salts are preferred.

Included among the polycarboxylate builders are a variety of categories of useful materials. One important category of polycarboxylate builders encompasses the ether polycarboxylates, including oxydisuccinate, as disclosed in Berg, U.S. Pat. No. 3,128,287, issued Apr. 7, 1964, and Lamberti et al, U.S. Pat. No. 3,635,830, issued Jan. 18, 1972. See also "TMS/TDS" builders of U.S. Pat. No. 4,663,071, issued to Bush et al, on May 5, 1987. Suitable ether polycarboxylates also include cyclic compounds, particularly alicyclic compounds, such as those described in U.S. Pat. Nos. 3,923,679; 3,835,163; 4,158,635; 4,120,874 and 4,102,903.

Citrate builders, e.g., citric acid and soluble salts thereof (particularly sodium salt), are polycarboxylate builders of importance for liquid detergent formulations due to their availability from renewable resources and their biodegradability. Oxydisuccinates are also especially useful in such compositions and combinations.

Also suitable in the compositions of the present invention are the 3,3-dicarboxy-4-oxa-1,6-hexanedioates and the related compounds disclosed in U.S. Pat. No. 4,566,984, Bush, issued Jan. 28, 1986. Laurylsuccinates are the preferred builders of this group, and are described in European Patent Application 86200690.5/0,200,263, published Nov. 5, 1986.

Other suitable polycarboxylates are disclosed in U.S. Pat. No. 4,144,226, Crutchfield et al, issued Mar. 13, 1979 and in U.S. Pat. No. 3,308,067, Diehl, issued Mar. 7, 1967. See also Diehl U.S. Pat. No. 3,723,322.

Fatty acids, e.g., $C_{12}$-$C_{18}$ monocarboxylic acids, can also be incorporated into the compositions alone, or in combination with the aforesaid builders, especially citrate and/or the succinate builders, to provide additional builder activity.

Preferred builders herein include the various alkali metal phosphates such as the well-known sodium tripolyphosphates, sodium pyrophosphate and sodium orthophosphate. Phosphonate builders such as ethane-1-hydroxy-1,1-diphosphonate and other known phosphonates (see, for example, U.S. Pat. Nos. 3,159,581; 3,213,030; 3,422,021; 3,400,148; and 3,422,137) can also be used though such materials are more commonly used in a low-level mode as chelants or stabilizers. Sodium and/or potassium tripolyphosphate is a particularly preferred builder herein, and preferably is used at a level of from about 15% to 35%, more preferably from about 20% to about 30%, by weight of the composition.

(e) Other Adjunct Detergent Ingredients

The liquid or gel detergent composition may optionally contain up to about 20% of a dispersant polymer selected from the group consisting of polyacrylates and polyacrylate copolymers.

The compositions of the present invention may also contain other enzymes and enzyme stabilizing agents such as short chain carboxylic acids as disclosed in WO 98/03622, published Jan. 29, 1998, U.S. Pat. No. 4,537,707, Severson, and U.S. Pat. No. 4,318,818, Letton, et. al., all incorporated herein by reference.

The compositions herein may also contain bleaching agents and activators, material care agents, and chelating agents such as disclosed in WO 98/03622, incorporated herein by reference.

To exemplify the present invention and demonstrate its benefits, the following gel detergent formulas are prepared containing α-amylase, boric acid, 1-2-propanediol and calcium ion at the levels indicated.

TABLE 1

| Ingredients (active) | Formula A | Formula B |
|---|---|---|
| Sodium tripolyphosphate | 22.0 | 22.0 |
| KOH | 4.7 | 7.5 |
| $H_2SO_4$ | 3.9 | 3.9 |
| Boric Acid | 3.0 | * |
| 1,2-propanediol | 0.5 | * |
| $CaCl_2 \bullet 2H_2O$ | * | * |
| Nonionic surfactant (SLF18) | 1.0 | 1.0 |
| Protease (3.4% active) | 0.6 | 0.6 |
| α-Amylase* (2.7% active) | 0.17 | 0.17 |
| Polyacrylate thickener (Polygel DKP) | 1.18 | 1.02 |
| Perfume | 0.10 | 0.10 |
| Deionized water & minors | BALANCE | BALANCE |
| (pH at 1% in water) | (8.5) | (9.5) |

*As indicated in Table 2.

The above compositions are prepared by mixing the ingredients in the following order. A solution premix is made by mixing water, potassium hydroxide, sulfuric acid, propanediol, boric acid and sodium tripolyphosphate (STP) in a stainless steel tank. The premix is recirculated through a high shear mixer to grind the STP to a particle size range of about 10-70 microns. A heat exchanger is used to remove heat from the batch. A polymer premix is prepared by dissolving the polyacrylate thickener in a weakly acidified water-nitric acid solution. The polymer solution is then neutralized with the first premix to make a gel base. Continuous mixing with the first premix causes the polymer to swell and provide a gel-like texture. The product is then cooled prior to the addition of the nonionic surfactant, enzymes, perfume and minors. The finished product is a stable gel detergent particularly useful as an automatic dishwashing detergent composition.

The stability of the α-amylase in the above formulas, as determined by % amylase remaining after storage at 90° F. (32.2° C.) for 1, 2, 3 and 4 weeks, is shown in Table 2.

TABLE 2

| Formula | % Amylase remaining at 90° F. (32.2° C.) after # weeks | | | |
|---|---|---|---|---|
| | 1 | 2 | 3 | 4 |
| 1. A with Natalase ®, 0.037% $CaCl_2 \bullet 2H_2O$ (3.3 millimoles $Ca^{++}$/liter), 3.0% boric acid, 0.5% 1,2-propanediol | 56.1 | 38.3 | 31.1 | 25.0 |
| 2. A with Natalase ®, 0.22% $CaCl_2 \bullet 2H_2O$ (20 millimoles $Ca^{++}$/liter), 3.0% boric acid, 0.5% 1,2-propanediol | 89.2 | 82.1 | 75.2 | 70.4 |
| 3. B with Termamyl ®, 0.037% $CaCl_2 \bullet 2H_2O$ (3.3 millimoles $Ca^{++}$/liter), 3.0% boric acid, 0.5% 1,2-propanediol | 79.3 | 70.6 | 55.2 | 39.4 |
| 4. B with Termamyl ®, 0.22% $CaCl_2 \bullet 2H_2O$ (20 millimoles $Ca^{++}$/liter), 3.0% boric acid, 0.5% 1,2 propanediol | 80.8 | 75.3 | 59.8 | 48.7 |
| 5. B with Natalase ®, 0.073% $CaCl_2 \bullet 2H_2O$ (6.7 millimoles $Ca^{++}$/liter), 3.0% boric acid, 0.5% 1,2 propanediol | 76.6 | 65.3 | 50.9 | 39.3 |
| 6. B with Natalase ®, 0.147% $CaCl_2 \bullet 2H_2O$ (13.3 millimoles $Ca^{++}$/liter), 3.0% boric acid, 0.5% 1,2 propanediol | 88.6 | 77.8 | 70.3 | 61.4 |
| 7. B with Natalase ®, 0.22% $CaCl_2 \bullet 2H_2O$ (20 millimoles $Ca^{++}$/liter), 3.5% boric acid, 0% 1,2 propanediol | 59.5 | 42.6 | 31.2 | 26.1 |
| 8. B with Natalase ®, 0.22% $CaCl_2 \bullet 2H_2O$ (20 millimoles $Ca^{++}$/liter), 0% boric acid, 3.5% 1,2 propanediol | 44.6 | 20.8 | 9.0 | 5.8 |
| 9. B with Natalase ®, 0.22% $CaCl_2 \bullet 2H_2O$ (20 millimoles $Ca^{++}$/liter), 3.0% boric acid, 0.5% 1,2 propanediol | 95.6 | 88.9 | 74.5 | 65.8 |

As can be seen above, the Natalase® in Formula 2 of the present invention has better stability with 20 millimoles of calcium ion per liter than with the lower level of calcium in Formula 1.

In contrast, increasing the calcium level from 3.3 to 20 millimoles of calcium ion per liter does not significantly improve Termamyl® stability in a similar base Formula B (compare results for Formula 4 versus Formula 3).

The Natalase® in Formula 6 of the present invention containing 13.3 millimoles of calcium ion per liter also has better stability than in Formula 5 containing only 6.7 millimoles of calcium ion per liter.

Even at the higher level of 20 millimoles of calcium ion per liter, both boric acid and diol are necessary for good Natalase® stability, as can be seen by comparing the results for Formula 9 of the invention versus Formula 7 with no diol and Formula 8 with no boric acid.

Other compositions of the present invention are as follows:

TABLE 3

| Ingredients (active) | Formula C | Formula D |
|---|---|---|
| Sodium Tripolyphosphate | 22.0 | |
| Sodium citrate | | 20.0 |
| KOH | 7.5 | 4.6 |
| $H_2SO_4$ | 3.9 | 3.9 |
| Boric Acid | 3.0 | 2.0 |
| 1,2 propanediol | 0.5 | 2.0 |
| $CaCl_2 \bullet 2H_2O$ | 0.22 | 0.037 |
| Nonionic surfactant (SLF18) | 1.0 | 3.5 |
| Protease (3.4% active) | 0.6 | 0.6 |
| Natalase ® (2.7% active) | 0.27 | 0.5 |
| Polyacrylate thickener (Polygel DKP) | 1.18 | 1.18 |
| Perfume | 0.10 | 0.10 |

TABLE 3-continued

| Ingredients (active) | Formula C | Formula D |
|---|---|---|
| Deionized water & minors | BALANCE | BALANCE |
| (pH at 1% in water) | (9.6) | |

Other compositions of the invention are obtained when, in the above Formulas A-D, the boric acid is replaced with sodium borate, and/or the 1,2-propanediol is replaced with ethylene glycol, propylene glycol, glycerol and sorbitol.

Accordingly, having thus described the invention in detail, it will be obvious to those skilled in the art that various changes may be made without departing from the scope of the invention, and the invention is not to be considered limited to what is described in the specification.

SEQUENCE LISTING

```
<160> NUMBER OF SEQ ID NOS: 4

<210> SEQ ID NO 1
<211> LENGTH: 485
<212> TYPE: PRT
<213> ORGANISM: alkaliphilicbacillus

<400> SEQUENCE: 1

His His Asn Gly Thr Asn Gly Thr Met Met Gln Tyr Phe Glu Trp Tyr
1               5                   10                  15

Leu Pro Asn Asp Gly Asn His Trp Asn Arg Leu Arg Asp Asp Ala Ala
            20                  25                  30

Asn Leu Lys Ser Lys Gly Ile Thr Ala Val Trp Ile Pro Pro Ala Trp
        35                  40                  45

Lys Gly Thr Ser Gln Asn Asp Val Gly Tyr Gly Ala Tyr Asp Leu Tyr
    50                  55                  60

Asp Leu Gly Glu Phe Asn Gln Lys Gly Thr Val Arg Thr Lys Tyr Gly
65                  70                  75                  80

Thr Arg Asn Gln Leu Gln Ala Ala Val Thr Ser Leu Lys Asn Asn Gly
                85                  90                  95

Ile Gln Val Tyr Gly Asp Val Val Met Asn His Lys Gly Gly Ala Asp
            100                 105                 110

Gly Thr Glu Ile Val Asn Ala Val Glu Val Asn Arg Ser Asn Arg Asn
        115                 120                 125

Gln Glu Thr Ser Gly Glu Tyr Ala Ile Glu Ala Trp Thr Lys Phe Asp
    130                 135                 140

Phe Pro Gly Arg Gly Asn Asn His Ser Ser Phe Lys Trp Arg Trp Tyr
145                 150                 155                 160

His Phe Asp Gly Thr Asp Trp Asp Gln Ser Arg Gln Leu Gln Asn Lys
                165                 170                 175

Ile Tyr Lys Phe Arg Gly Thr Gly Lys Ala Trp Asp Trp Glu Val Asp
            180                 185                 190

Thr Glu Asn Gly Asn Tyr Asp Tyr Leu Met Tyr Ala Asp Val Asp Met
        195                 200                 205

Asp His Pro Glu Val Ile His Glu Leu Arg Asn Trp Gly Val Trp Tyr
    210                 215                 220

Thr Asn Thr Leu Asn Leu Asp Gly Phe Arg Ile Asp Ala Val Lys His
225                 230                 235                 240

Ile Lys Tyr Ser Phe Thr Arg Asp Trp Leu Thr His Val Arg Asn Thr
                245                 250                 255

Thr Gly Lys Pro Met Phe Ala Val Ala Glu Phe Trp Lys Asn Asp Leu
            260                 265                 270

Gly Ala Ile Glu Asn Tyr Leu Asn Lys Thr Ser Trp Asn His Ser Val
        275                 280                 285

Phe Asp Val Pro Leu His Tyr Asn Leu Tyr Asn Ala Ser Asn Ser Gly
```

-continued

```
    290                 295                 300

Gly Tyr Tyr Asp Met Arg Asn Ile Leu Asn Gly Ser Val Val Gln Lys
305                 310                 315                 320

His Pro Thr His Ala Val Thr Phe Val Asp Asn His Asp Ser Gln Pro
                325                 330                 335

Gly Glu Ala Leu Glu Ser Phe Val Gln Gln Trp Phe Lys Pro Leu Ala
            340                 345                 350

Tyr Ala Leu Val Leu Thr Arg Glu Gln Gly Tyr Pro Ser Val Phe Tyr
        355                 360                 365

Gly Asp Tyr Tyr Gly Ile Pro Thr His Gly Val Pro Ala Met Lys Ser
    370                 375                 380

Lys Ile Asp Pro Leu Leu Gln Ala Arg Gln Thr Phe Ala Tyr Gly Thr
385                 390                 395                 400

Gln His Asp Tyr Phe Asp His His Asp Ile Ile Gly Trp Thr Arg Glu
                405                 410                 415

Gly Asn Ser Ser His Pro Asn Ser Gly Leu Ala Thr Ile Met Ser Asp
            420                 425                 430

Gly Pro Gly Gly Asn Lys Trp Met Tyr Val Gly Lys Asn Lys Ala Gly
        435                 440                 445

Gln Val Trp Arg Asp Ile Thr Gly Asn Arg Thr Gly Thr Val Thr Ile
    450                 455                 460

Asn Ala Asp Gly Trp Gly Asn Phe Ser Val Asn Gly Gly Ser Val Ser
465                 470                 475                 480

Val Trp Val Lys Gln
                485


<210> SEQ ID NO 2
<211> LENGTH: 485
<212> TYPE: PRT
<213> ORGANISM: alkaliphilicbacillus

<400> SEQUENCE: 2

His His Asn Gly Thr Asn Gly Thr Met Met Gln Tyr Phe Glu Trp His
1               5                   10                  15

Leu Pro Asn Asp Gly Asn His Trp Asn Arg Leu Arg Asp Asp Ala Ser
            20                  25                  30

Asn Leu Arg Asn Arg Gly Ile Thr Ala Ile Trp Ile Pro Pro Ala Trp
        35                  40                  45

Lys Gly Thr Ser Gln Asn Asp Val Gly Tyr Gly Ala Tyr Asp Leu Tyr
    50                  55                  60

Asp Leu Gly Glu Phe Asn Gln Lys Gly Thr Val Arg Thr Lys Tyr Gly
65                  70                  75                  80

Thr Arg Ser Gln Leu Glu Ser Ala Ile His Ala Leu Lys Asn Asn Gly
                85                  90                  95

Val Gln Val Tyr Gly Asp Val Val Met Asn His Lys Gly Gly Ala Asp
            100                 105                 110

Ala Thr Glu Asn Val Leu Ala Val Glu Val Asn Pro Asn Asn Arg Asn
        115                 120                 125

Gln Glu Ile Ser Gly Asp Tyr Thr Ile Glu Ala Trp Thr Lys Phe Asp
    130                 135                 140

Phe Pro Gly Arg Gly Asn Thr Tyr Ser Asp Phe Lys Trp Arg Trp Tyr
145                 150                 155                 160

His Phe Asp Gly Val Asp Trp Asp Gln Ser Arg Gln Phe Gln Asn Arg
                165                 170                 175
```

-continued

```
Ile Tyr Lys Phe Arg Gly Asp Gly Lys Ala Trp Asp Trp Glu Val Asp
            180                 185                 190

Ser Glu Asn Gly Asn Tyr Asp Tyr Leu Met Tyr Ala Asp Val Asp Met
        195                 200                 205

Asp His Pro Glu Val Val Asn Glu Leu Arg Arg Trp Gly Glu Trp Tyr
    210                 215                 220

Thr Asn Thr Leu Asn Leu Asp Gly Phe Arg Ile Asp Ala Val Lys His
225                 230                 235                 240

Ile Lys Tyr Ser Phe Thr Arg Asp Trp Leu Thr His Val Arg Asn Ala
                245                 250                 255

Thr Gly Lys Glu Met Phe Ala Val Ala Glu Phe Trp Lys Asn Asp Leu
            260                 265                 270

Gly Ala Leu Glu Asn Tyr Leu Asn Lys Thr Asn Trp Asn His Ser Val
        275                 280                 285

Phe Asp Val Pro Leu His Tyr Asn Leu Tyr Asn Ala Ser Asn Ser Gly
    290                 295                 300

Gly Asn Tyr Asp Met Ala Lys Leu Leu Asn Gly Thr Val Val Gln Lys
305                 310                 315                 320

His Pro Met His Ala Val Thr Phe Val Asp Asn His Asp Ser Gln Pro
                325                 330                 335

Gly Glu Ser Leu Glu Ser Phe Val Gln Glu Trp Phe Lys Pro Leu Ala
            340                 345                 350

Tyr Ala Leu Ile Leu Thr Arg Glu Gln Gly Tyr Pro Ser Val Phe Tyr
        355                 360                 365

Gly Asp Tyr Tyr Gly Ile Pro Thr His Ser Val Pro Ala Met Lys Ala
    370                 375                 380

Lys Ile Asp Pro Ile Leu Glu Ala Arg Gln Asn Phe Ala Tyr Gly Thr
385                 390                 395                 400

Gln His Asp Tyr Phe Asp His His Asn Ile Ile Gly Trp Thr Arg Glu
                405                 410                 415

Gly Asn Thr Thr His Pro Asn Ser Gly Leu Ala Thr Ile Met Ser Asp
            420                 425                 430

Gly Pro Gly Gly Glu Lys Trp Met Tyr Val Gly Gln Asn Lys Ala Gly
        435                 440                 445

Gln Val Trp His Asp Ile Thr Gly Asn Lys Pro Gly Thr Val Thr Ile
    450                 455                 460

Asn Ala Asp Gly Trp Ala Asn Phe Ser Val Asn Gly Gly Ser Val Ser
465                 470                 475                 480

Ile Trp Val Lys Arg
                485


<210> SEQ ID NO 3
<211> LENGTH: 20
<212> TYPE: PRT
<213> ORGANISM: alkaliphilicbacillus

<400> SEQUENCE: 3

His His Asn Gly Thr Asn Gly Thr Met Met Gln Tyr Phe Glu Trp Tyr
1               5                   10                  15

Leu Pro Asn Asp
            20


<210> SEQ ID NO 4
<211> LENGTH: 515
<212> TYPE: PRT
<213> ORGANISM: alkaliphilicbacillus
```

-continued

<400> SEQUENCE: 4

Ala Ala Pro Phe Asn Gly Thr Met Met Gln Tyr Phe Glu Trp Tyr Leu
1 5 10 15

Pro Asp Asp Gly Thr Leu Trp Thr Lys Val Ala Asn Glu Ala Asn Asn
20 25 30

Leu Ser Ser Leu Gly Ile Thr Ala Leu Trp Leu Pro Pro Ala Tyr Lys
35 40 45

Gly Thr Ser Arg Ser Asp Val Gly Tyr Gly Val Tyr Asp Leu Tyr Asp
50 55 60

Leu Gly Glu Phe Asn Gln Lys Gly Ala Val Arg Thr Lys Tyr Gly Thr
65 70 75 80

Lys Ala Gln Tyr Leu Gln Ala Ile Gln Ala Ala His Ala Ala Gly Met
85 90 95

Gln Val Tyr Ala Asp Val Val Phe Asp His Lys Gly Gly Ala Asp Gly
100 105 110

Thr Glu Trp Val Asp Ala Val Glu Val Asn Pro Ser Asp Arg Asn Gln
115 120 125

Glu Ile Ser Gly Thr Tyr Gln Ile Gln Ala Trp Thr Lys Phe Asp Phe
130 135 140

Pro Gly Arg Gly Asn Thr Tyr Ser Ser Phe Lys Trp Arg Trp Tyr His
145 150 155 160

Phe Asp Gly Val Asp Trp Asp Glu Ser Arg Lys Leu Ser Arg Ile Tyr
165 170 175

Lys Phe Arg Gly Ile Gly Lys Ala Trp Asp Trp Glu Val Asp Thr Glu
180 185 190

Asn Gly Asn Tyr Asp Tyr Leu Met Tyr Ala Asp Leu Asp Met Asp His
195 200 205

Pro Glu Val Val Thr Glu Leu Lys Ser Trp Gly Lys Trp Tyr Val Asn
210 215 220

Thr Thr Asn Ile Asp Gly Phe Arg Leu Asp Ala Val Lys His Ile Lys
225 230 235 240

Phe Ser Phe Phe Pro Asp Trp Leu Ser Asp Val Arg Ser Gln Thr Gly
245 250 255

Lys Pro Leu Phe Thr Val Gly Glu Tyr Trp Ser Tyr Asp Ile Asn Lys
260 265 270

Leu His Asn Tyr Ile Met Lys Thr Asn Gly Thr Met Ser Leu Phe Asp
275 280 285

Ala Pro Leu His Asn Lys Phe Tyr Thr Ala Ser Lys Ser Gly Gly Thr
290 295 300

Phe Asp Met Arg Thr Leu Met Thr Asn Thr Leu Met Lys Asp Gln Pro
305 310 315 320

Thr Leu Ala Val Thr Phe Val Asp Asn His Asp Thr Glu Pro Gly Gln
325 330 335

Ala Leu Gln Ser Trp Val Asp Pro Trp Phe Lys Pro Leu Ala Tyr Ala
340 345 350

Phe Ile Leu Thr Arg Gln Glu Gly Tyr Pro Cys Val Phe Tyr Gly Asp
355 360 365

Tyr Tyr Gly Ile Pro Gln Tyr Asn Ile Pro Ser Leu Lys Ser Lys Ile
370 375 380

Asp Pro Leu Leu Ile Ala Arg Arg Asp Tyr Ala Tyr Gly Thr Gln His
385 390 395 400

Asp Tyr Leu Asp His Ser Asp Ile Ile Gly Trp Thr Arg Glu Gly Val

-continued

```
                405                 410                 415

Thr Glu Lys Pro Gly Ser Gly Leu Ala Ala Leu Ile Thr Asp Gly Pro
            420                 425                 430

Gly Gly Ser Lys Trp Met Tyr Val Gly Lys Gln His Ala Gly Lys Val
        435                 440                 445

Phe Tyr Asp Leu Thr Gly Asn Arg Ser Asp Thr Val Thr Ile Asn Ser
    450                 455                 460

Asp Gly Trp Gly Glu Phe Lys Val Asn Gly Gly Ser Val Ser Val Trp
465                 470                 475                 480

Val Pro Arg Lys Thr Thr Val Ser Thr Ile Ala Trp Ser Ile Thr Thr
                485                 490                 495

Arg Pro Trp Thr Asp Glu Phe Val Arg Trp Thr Glu Pro Arg Leu Val
            500                 505                 510

Ala Trp Pro
        515
```

What is claimed is:

1. An aqueous liquid or gel detergent composition comprising, by weight:

(1) from about 1% to about 5% of boric acid;

(2) from about 0.1% to about 7% of 1,2-propanediol;

(3) from about 10 to about 50 millimoles of calcium chloride per liter of composition;

(4) from about 40% to about 70% of water; and (5) from about 0.001% to about 0.5% of an α-amylase enzyme of SEQ ID NO: 2.

2. The detergent composition according to claim 1, comprising from about 0.1% to about 3% by weight of 1,2-propanediol.

3. The detergent composition according to claim 1, comprising from about 13 to about 50 millimoles of calcium chloride per liter of composition.

4. The detergent composition according to claim 1 comprising from about 15 to about 30 millimoles of calcium chloride per liter of composition.

5. The detergent composition according to claim 1 further comprising a protease enzyme.

6. The detergent composition according to claim 5, comprising from about 0.1% to about 2% of the protease enzyme.

7. The detergent composition according to claim 1, wherein the composition further comprises from about 15% to about 35% alkali metal phosphate and from about 0.1% to about 10% alkyl ethoxylate surfactant.

8. The detergent composition according to claim 7, comprising from about 20% to about 30% of the alkali metal phosphate.

9. The detergent composition according to claim 7, having a pH of from about 8.0 to about 11.0 when measured at a concentration of 1% by weight in water.

10. A process for stabilizing an amylase enzyme in an aqueous liquid or gel detergent composition, comprising mixing, with detergent ingredients:

(1) from about 1% to about 5% of boric acid;

(2) from about 0.1% to about 7% of 1,2-propanediol;

(3) from about 10 to about 50 millimoles of calcium chloride per liter of composition;

(4) from about 40% to about 70% of water; and (5) from about 0.001 to about 0.5% of an α-amylase enzyme of SEQ ID NO: 2.

11. A process according to claim 10 comprising mixing from about 13 to about 50 millimoles of the calcium chloride per liter of composition.

12. A process according to claim 10, further comprising mixing from about 0.1% to about 2% of a protease enzyme with the detergent ingredients.

13. A process according to claim 10, comprising mixing from about 15 to about 30 millimoles of the calcium chloride per liter of composition.

14. A process according to claim 10, wherein the detergent ingredients comprise from about 15% to about 35% alkali metal phosphate and from about 0.1% to about 10% alkyl ethoxylate surfactant.

15. A process according to claim 14, wherein the detergent ingredients comprise from about 20% to about 30% alkali metal phosphate.

16. A process according to claim 14, wherein the aqueous liquid or gel detergent composition has a pH of from about 8.0 to about 11.0 when measured at a concentration of 1% by weight in water.

* * * * *